United States Patent [19]

Kranz

[11] Patent Number: 4,756,492

[45] Date of Patent: Jul. 12, 1988

[54] HIGH VELOCITY AERODYNAMIC BODY HAVING TELESCOPIC PIVOTAL TIP

[75] Inventor: Walter Kranz, Taufkirchen, Fed. Rep. of Germany

[73] Assignee: Messerscmitt-Bölkow-Blohm GmbH, Munich, Fed. Rep. of Germany

[21] Appl. No.: 32,747

[22] Filed: Mar. 31, 1987

[30] Foreign Application Priority Data

Apr. 11, 1986 [DE] Fed. Rep. of Germany ..... 3612175

[51] Int. Cl.[4] ..... F42B 15/053

[52] U.S. Cl. ..... 244/3.1

[58] Field of Search ..... 244/3.1, 3.15, 3.21, 244/3.23, 3.24, 3.26, 3.27; 102/382, 384, 473, 490, 501

[56] References Cited

U.S. PATENT DOCUMENTS

| | | | |
|---|---|---|---|
| 3,067,682 | 12/1962 | Feldmann et al. | 244/3.23 |
| 3,195,462 | 7/1965 | Petre | 244/3.21 X |
| 3,262,655 | 7/1966 | Gillespie, Jr. | 244/3.1 X |
| 4,351,503 | 9/1982 | Drori | 102/385 X |
| 4,399,962 | 8/1983 | Wedertz et al. | 244/3.23 |
| 4,579,298 | 4/1986 | Thomson | 244/3.1 X |

*Primary Examiner*—Ted L. Parr

*Attorney, Agent, or Firm*—Kenyon & Kenyon

[57] ABSTRACT

A high velocity aerodynamic body, particularly a shell flying at supersonic velocity, having a device for stabilizing the aerodynamic body and for reducing its oscillation. The aerodynamic body has in the vicinity of its tip, a rotation symmetrical tip enclosure which is supported, with balanced mass, about a support point located on the longitudinal axis of the aerodynamic body, freely tiltably on all sides.

5 Claims, 2 Drawing Sheets

HIGH VELOCITY AERODYNAMIC BODY HAVING TELESCOPIC PIVOTAL TIP

BACKGROUND OF THE INVENTION

The present invention relates to high velocity aerodynamic bodies, especially shells flying at supersonic velocities.

Such aerodynamic bodies can be stabilized by the provision that aerodynamically active structural parts such as fins, rudders, a tail cone or the like, are designed in such a way that the pressure point comes to lie behind the center of gravity of the aerodynamic body, as seen from the tip of the aerodynamic body. Such measures can limit the field of application of an aerodynamic body, especially a shell flying at supersonic velocity, or they require possibly relatively complicated mechanical solutions, especially if the aerodynamic body must be launched from a tube. There, either special structures must be provided at the launching tube or it must be possible to swing the aerodynamically active structural parts into the contour of the aerodynamic body during the launching.

A further possibility is the spin stabilization of shells. This presumes a large amount of structural means for the launching tube with spin rifling, the launching tube as well as the aerodynamic body being heavily stressed mechanically during the launching. In addition, the range of the aerodynamic body is reduced by spin stabilization.

SUMMARY OF THE INVENTION

It is, therefore, an object of the invention to provide a simple aerodynamic stabilizing device without increasing the bore diameter of the aerodynamic body to be launched without spin.

The above and other objects of the invention are achieved by a high velocity aerodynamic body, particularly a shell flying at supersonic velocity, having means for stabilizing the aerodynamic body and for reducing the oscillation thereof, said stabilizing means comprising, in the vicinity of the tip of the aerodynamic body, a substantially conical tip enclosure with rotational symmetry which is supported, with balanced masses, freely tiltably from all sides about a support point located on the longitudinal axis of the aerodynamic body.

Accordingly, a mass-balanced tip enclosure of the aerodynamic body which is freely movable to all sides and the center of gravity of which coincides essentially with the support point, serves as a stabilizing device. Its pressure point is located behind the support point in order to keep the tip enclosure aerodynamically stable. Due to the pressure distribution, the tip enclosure aligns itself into the wind during the flight, i.e., into the oncoming flow device and thus does not generate substantial moments about the axis of the aerodynamic body. Thereby, the aerodynamic body is stabilized and drawn into the wind since the customary pressure distribution behind the tip enclosure, in connection with the center of gravity of the aerodynamic body, generates a stabilizing moment and since the interfering moments on the tip enclosure which are largely due to the events behind and in it, are small.

The design and support of the tip enclosure are relatively simple and in any case, the bore of the aerodynamic body is not increased by the tip enclosure, so that the former can be launched as a high velocity shell from a launching tube without spin. According to one embodiment, the tip enclosure is advantageously supported at the front end of a telescope cylinder which is extended only a certain time after the launching of the aerodynamic body when the flow conditions at the tip envelope no longer have a destabilizing effect on the latter.

The telescope cylinder can be extended mechanically or pyrotechnically according to a further embodiment.

BRIEF DESCRIPTION OF THE DRAWINGS

The invention will be explained in greater detail in the following description, with reference to the drawings, in which.

DETAILED DESCRIPTION

Figure 1A:
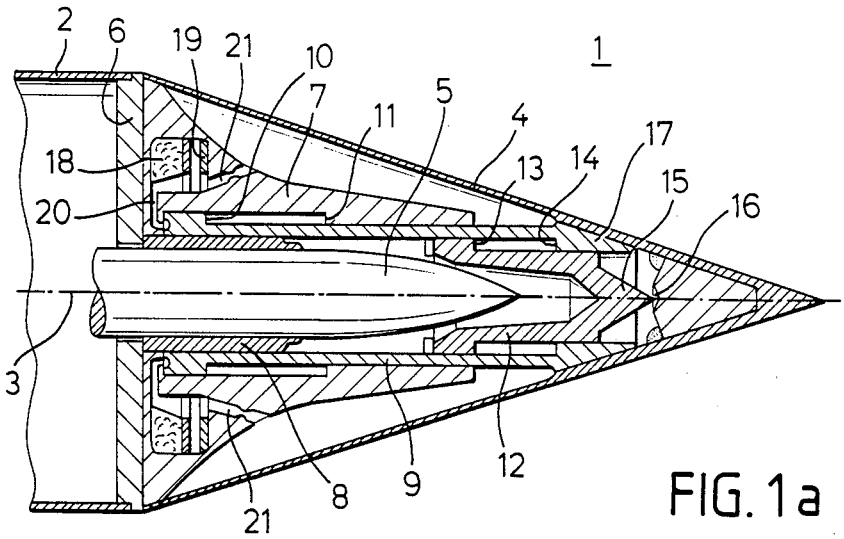
FIGS. 1*a* to 1*c* respectively show sections through a shell tip with a tip enclosure which is brought from a rest position shown in FIG 1*a*, with the aid of a telescope cylinder via an intermediate position shown in FIG. 1*b* into the active position shjown in FIG. 1*c*, in which it serves for stabilizing the shell.

With reference to the drawings, a shell 1 flying at supersonic speed has a cylindrical housing 2, only indicated in part in the figures, with a longitudinal axis 3, which is followed by a thin-walled conical tip enclosure 4 as the tip of the aerodynamic body. On the longitudinal axis 3 of the shell is located an inertial core 5 which penetrates the target on impact. The cylindrical shell housing 2 is closed off toward the tip enclosure 4 by a partition 6 which supports a guide body 7 which is formed in the manner of a truncated cone and protrudes into the tip enclosure 4. The inertial core 5 penetrating the partition 6 is surrounded by a guiding sleeve 8 over part of its length. Between this stationary guiding sleeve and the truncated cone guiding body 7 slides a first telescope 9 which supports, at the rear end facing the partition 6, a stop 10 which engages a corresponding stop 11 of the guiding body 7 spaced therefrom. In the first extendable telescope tube 9 is supported a second extendable telescope tube 12. The extended length of this telescope tube 12 is limited by two stops 13 and 14 at the two telescope tubes 12 and 9. At its front end, the telescope tube 12 carries a tip located on the longitudinal axis 3 which is located in a front insertion part of the tip enclosure 4 opposite a triangular recess 16.

In the rest position of the tip enclosure 4 according to FIG 1*a*, the tip enclosure 4 is supported, for one, by the guiding body 7 in the vicinity of the partition and secondly, at the telescope tube 9 on an outer front shoulder 17. The tip 15 and the recess 16 do not engage each other.

In the guiding body 7 is located, adjacent to the partition 6, a circular gas generator 18, the pyrotechnical propulsion charge of which can be ignited by an inertial ring 19. The gas generator is in communication via several canals 20 with the guiding body 7, guiding sleeve 8, and the telescopic cylinder formed by the two telescope tubes 9 and 12, the canals 20 leading into the telescope cylinder behind the stop 10 of the telescopic tube 9. In addition, still further canal's 21 start from the gas generator 18, which open into the space between the guiding body 7 and the tip enclosure 4.

Figure 1B:
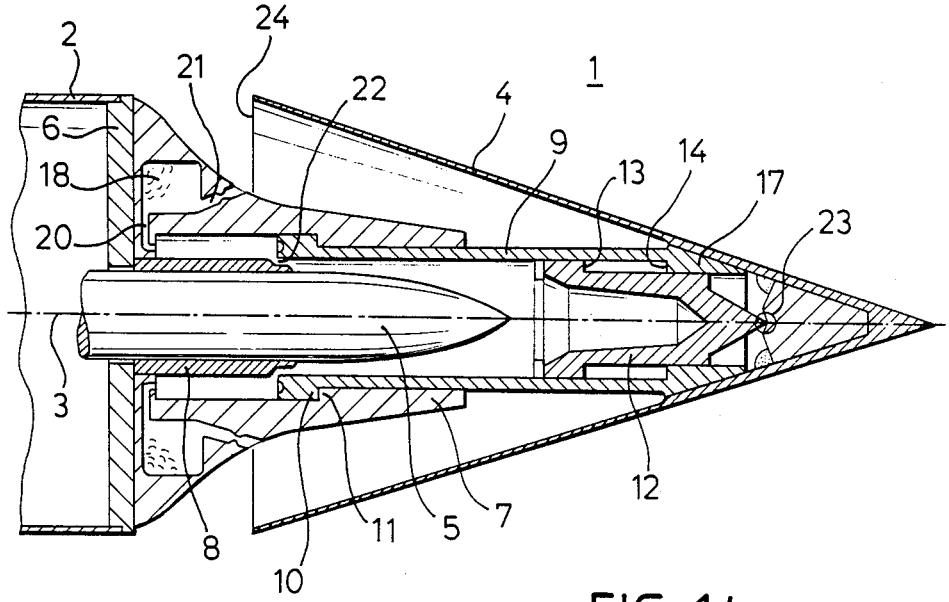

When the shell is launched from the launching tube, not shown, the inertial ring 19 is accelerated due to its inertia in the direction toward the pyrotechnical charge of the gas generator and ignites the latter. Gas now flows into the telescope cylinder via the canals 20 and pushes on the stop 10 of the first telescope tube 9. The latter is pushed forward until the stop 10 engages the stop 11 at the guiding body 7. During this extension motion, the tip envelope 4 is further supported on the shoulder 17 of the telescope tube. In addition, the tip envelope 4 is stabilized by the gas escaping from the canals 21. This interim state is shown in FIG. 1*b*.

In this interim state a circular slot 22 between the stop 10 of the telescope tube 9 and the guiding sleeve 8 is released so that then also the gas of the gas generator can flow into the interior of the telescope tube 9 and pushes in the process the second extendable telescope tube 12 forward. First, its tip 15 runs into the recess 16 of the tip enclosure, so that the latter is supported in the manner of a tip support at the point of contact, i.e., at the support point 23. Upon further extension of the inner telescope tube 12, the form-locking connection of the tip enclosure 4 at the shoulder 17 of the first telescope tube opens. If the stops 13 and 14 at the inner and outer telescope tube come into contact, the tip enclosure 4 has reached a position according to FIG. 1*c*, in which it is freely tiltable about the support point 23 in all directions. In order to stabilize the tip enclosure aerodynamically, the support point 23 is chosen so that it lies in front of the aerodynamic pressure point. The tip enclosure 4 can align itself into the on-flowing wind in the state shown in FIG. 1*c*.

The described delayed release of the tip envelope takes place only after a sufficiently large distance between the rear edge 24 and the partition 6 is reached, so that asymmetrical suction effects from the interior of the tip enclosure or build-up asymmetries in the region of the rear edge 24, which could be caused by drawn-in air flow, remain limited to a minimum. These disturbances are also kept small by blowing gas into the tip enclosure via the canals 21. If the disturbances occurring during the separation of the rear edge 24 from the stop at the support body 7 are only small, the tip enclosure 4 can also be pushed forward by joint extension of the two telescope tubes 9 and 12. In such a case it is possible, for instance, to extend the telescope cylinder by means of a mechanical spring.

Figure 1C:
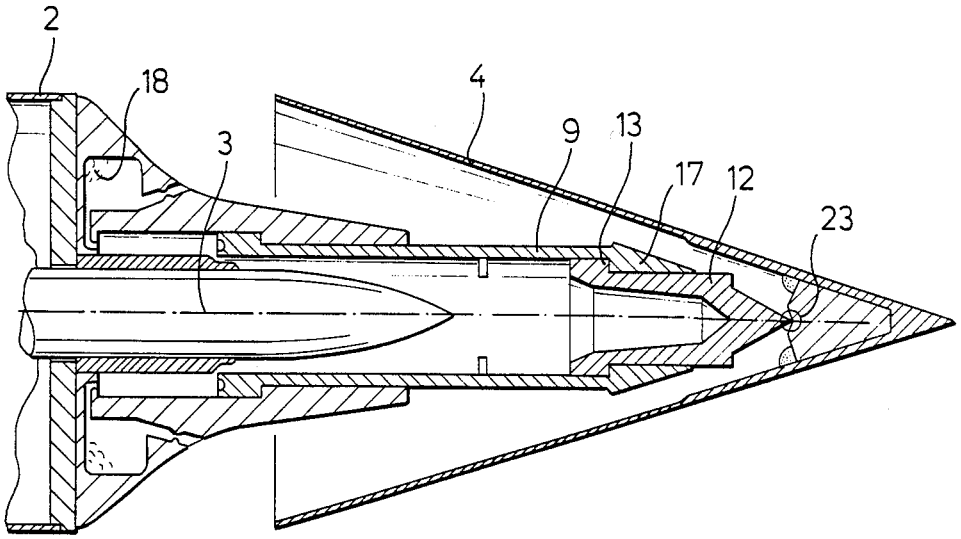

If the flow against the shell 1 is parallel to the axis during the flight in the position of the tip enclosure shown in FIG. 1*c*, it remains in the ideal flight regime, in which the direction of flight and the direction of the longitudinal axis 3 coincide. If, however, this flow changes due to an oscillation of the shell, the freely movable tip enclosure 4 aligns itself into the wind so that the axis of the tip enclosure no longer coincides with the longitudinal axis 3 of the shell 1. This results in different flow conditions on opposite sides in the region of the shell housing 2, so that the latter is, so to speak, drawn into the wind. This counteracts the oscillation of the shell and the shell is stabilized. In addition, it would also be possible to blow gas via the canals 21 into the interior of the tip enclosure 4 in a controlled manner in order to force the latter intentionally from the position coaxial with the shell housing 2. The flow conditions in the region of the shell housing 2 also change thereby. In this manner, control of the shell would be possible within certain limits.

The tip support between the inner telescope tube 12 and the tip enclosure 4 can, of course, be replaced by other supports, for instance, by a ball guide of the tip enclosure on the telescope tube.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A high velocity aerodynamic body having means for stabilizing the aerodynamic body and for reducing oscillation thereof, said aerodynamic body having a longitudinal axis and a tip at a forward end thereof, said stabilizing means comprising, in the vicinity of the tip of the aerodynamic body, a substantially conical tip enclosure having a line of rotational symmetry, said conical tip enclosure being balanced about said line of rotational symmetry and being freely tiltably supported from all sides about a support point located on said line of rotational symmetry, said line of rotational symmetry comprising the longitudinal axis of the aerodynamic body, said conical tip being supported at a front end of a telescopic cylinder which can be extended in the direction of the longitudinal axis of the aerodynamic body and which is connected at another end thereof to a housing of the aerodynamic body.

2. The aerodynamic body recited in claim 1, wherein the telescopic cylinder comprises a stationary telescopic tube coupled to the housing of the aerodynamic body, and first and second successively extendable telescopic tubes; the first extendable telescopic tube sliding in the stationary telescopic tube and extending before the second extendable telescopic tube, the second extendable telescopic tube sliding in the first extendable telescopic tube, the enclosure of the tip being held on a front shoulder of the first extendable telescopic tube in a form-locking manner; the support point for the tip enclosure being provided at the front end of the second extendable telescopic tube which is extended after the first extendable telescopic tube, thus releasing the form locking connection between the shoulder of the first telescopic tube and the tip enclosure.

3. The aerodynamic body recited in claim 1, wherein the telescopic cylinder can be actuated pneumatically.

4. The aerodynamic body recited in claim 3, further comprising a gas generator for actuating the telescopic cylinder.

5. The aerodynamic body recited in claim 4, wherein the gas generator is additionally in communication with blow-out openings which are arranged between the telescopic cylinder and an inside wall of the tip enclosure with rotational symmetry about the longitudinal axis of the aerodynamic body.

* * * * *